United States Patent [19]

Mason

[11] 4,030,309

[45] June 21, 1977

[54] WORK ARM SYSTEM FOR SUBMERGIBLE CHAMBER

[76] Inventor: Burton Hoster Mason, Box 504, Covington, La. 70433

[22] Filed: May 18, 1976

[21] Appl. No.: 687,549

[52] U.S. Cl. ..... 61/69 R; 114/50; 166/.5; 214/1 CM

[51] Int. Cl.[2] ..... B63C 11/40

[58] Field of Search ..... 61/69 R, 86, 105; 166/.5, .6; 114/16 R, 50, 51, .5 D; 214/1 CM; 294/88, 106

[56] References Cited

UNITED STATES PATENTS

| | | | |
|---|---|---|---|
| 1,873,617 | 8/1932 | Mehl | 61/69 R |
| 2,040,956 | 5/1936 | Romano | 61/69 R |
| 3,007,097 | 10/1961 | Shelley et al. | 214/1 CM |
| 3,381,485 | 5/1968 | Crooks et al. | 61/69 R |
| 3,451,224 | 6/1969 | Colechia et al. | 61/69 R |
| 3,851,491 | 12/1974 | Mason | 61/69 R |

*Primary Examiner*—Dennis L. Taylor
*Attorney, Agent, or Firm*—Marvin Feldman; Stephen E. Feldman

[57] ABSTRACT

A work arm system for a submergible chamber wherein a plurality of work arms are rotatably mounted to the chamber and are retractably extensible, so as to provide a plurality of tools for work at a subsea station, such as an offshore wellhead station. One arm is provided with tool mounts at opposite ends, both ends being retractably extensible so that each end may alternatively be disposed to the subsea station. The present work arm system permits several work functions to be performed without resurfacing of the chamber.

14 Claims, 4 Drawing Figures

WORK ARM SYSTEM FOR SUBMERGIBLE CHAMBER

This invention relates to submergible chambers for performing work at subsea locations. Specifically, this invention relates to a work arm system for such submergible chamber.

In Romano, U.S. Pat. No. 2,061,256, issued Nov. 17, 1936, there is disclosed a submarine salvage apparatus wherein two work arms are mounted to the chamber. Each work arm is designed for and provided with a single type of work tool.

In Mason, U.S. Pat. No. 3,851,491, issued Dec. 3, 1974, there is disclosed a submergible chamber wherein a single work arm is disclosed with a tool disposed at the outward end thereof, the arm being rotatably mounted to the chamber.

Such prior art work arms while serving their intended functions were limited insofar as the chamber had to be returned to the surface to change tools. This was particularly undesirable where the chamber was operating at an undersea station at depths of several hundred feet or more.

Now there is provided by the present invention, a work arm system fo performing a plurality of work functions at a subsea station without resurfacing of the chamber.

It is therefore an object of this invention to provide a work arm system for a submergible chamber wherein a plurality of work arms provides multiple tool functions.

It is another object of this invention to provide a work arm system as aforesaid wherein the work arms are rotatable about the axis of the chamber.

It is still another object of this invention to provide one of said work arms with tool mounts on opposite ends and provide for 180° rotation of the arm.

It is still a further object of this invention to provide in combination with the work arm, a rotatable tool mount platform wherein each of several tools may be in turn disposed to a work area.

The aforesaid as well as other objects and advantages which will become subsequently apparent in a reading of the construction and operation as more fully hereinafter described and claimed, reference being had to the accompanying drawings forming a part hereof, and in which:

Figure 2:
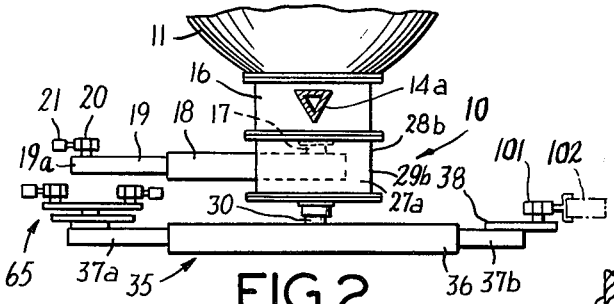
FIG. 2 is a reduced side elevational view of the apparatus of FIG. 1.
Figure 3:
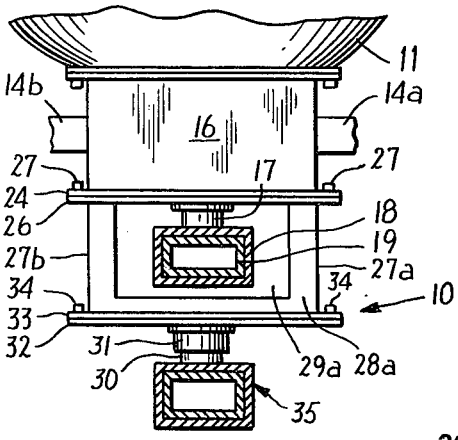
FIG. 3 is an enlarged sectional view taken along line 3—3 of FIG. 1.
Figure 1:
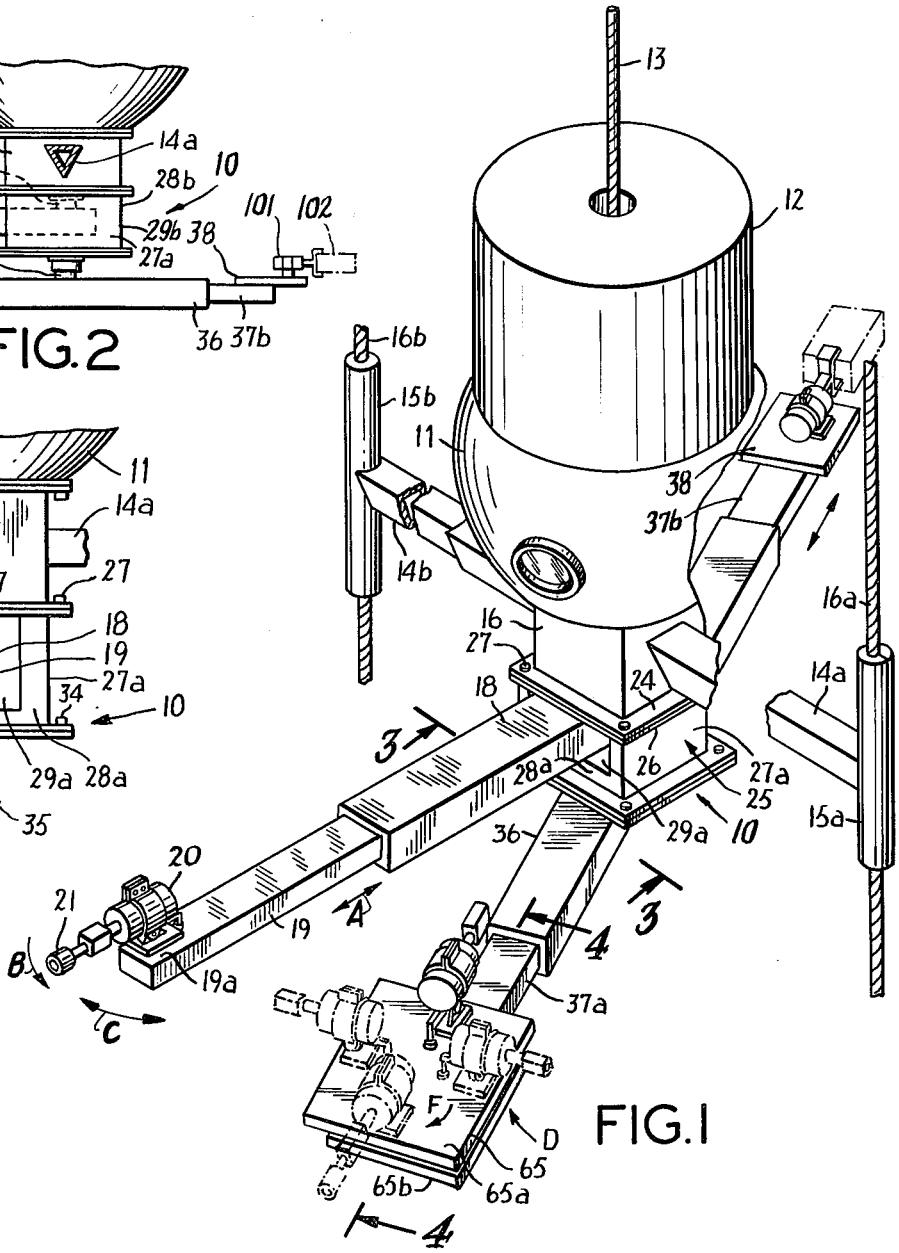
FIG. 1 is a perspective view of the apparatus of this invention.

Referring now to FIGS. 1–3, there is shown the apparatus of this invention generally designated as 10. A submergible chamber 11 has a ballast tank 12 mounted thereon and a surface-connected lift wire 13 attached to the chamber. A pair of outwardly disposed guide gripping arms 14*a* and 14*b* are attached to the chamber 11, and are each formed with a guide gripping member 15*a* and 15*b*, respectively, for grippingly holding the chamber to a pair of vertically disposed guide wires 16*a* and 16*b*, respectively. The guide clamping mechanism is more fully described in U.S. Pat. No. 3,851,491.

The guide arms 14*a* and 14*b* are mounted to housing 16 which is mounted to the bottom of spherical chamber 11. A rotatable shaft 17 is coaxial with the vertical axis of chamber 11, and is mounted to housing 16. Shaft 17 is operable by hydraulic means (not shown) housed within said chamber. A work arm portion 18 is mounted to shaft 17 so as to be rotatable therewith. A second work arm portion 19 is slidably housed within work arm portion 18 and is retractably extensible therewith as indicated by arrow A. At the outward end 19*a* of work arm portion 19, there is mounted a tool drive 20, for driving a tool such as impact wrench 21, for rotation as shown by arrow B. The tool drive 20 is hydraulic interconnected (not shown) to chamber 11 so that it may be operated remotely from within the chamber.

A second housing 25 is mounted to first housing 16 at mating flanges 24 and 26 by means of bolts 27. Housing 25 is formed of rectilinear construction having side walls 27*a* and 27*b* and end walls 28*a* and 28*b* being formed with coincident cut away windows 29*a* and 29*b*. Arm portion 18 extends through window 29*a* and is rotatable across the width of window 29*a*, as shown by arrow C.

A second rotatable shaft 30 with hydraulic drive 31 is mounted to second housing 25 at mating flanges 32 and 33 by means of bolts 34. Arm assembly 35 is mounted to shaft 30 so as to be rotatable at 180°, and preferably 360° as indicated by arrows D. Arm assembly 35 comprises arm portion 36 and arm portions 37*a* and 37*b*, each being retractably extensible within 36 as indicated by arrows E1 and E2, respectively. A fixed platform 38 is mounted at the outward end of arm portion 37*b*, and a rotatable platform 65 is mounted at the outward end of arm portion 37*a*.

Figure 4:
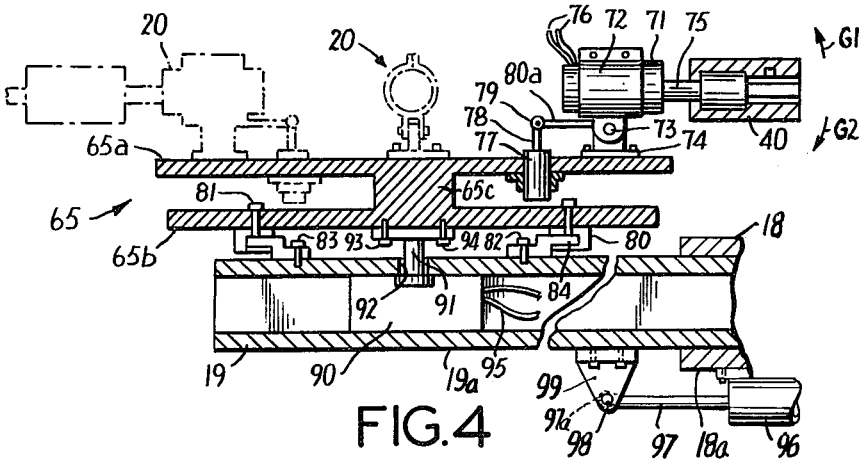
FIG. 4 is an enlarged sectional view taken along line 4—4 of FIG. 1.

Referring to FIGS. 3 and 4, platform 65 comprises upper plate 65*a* and lower plate 65*b* integrally connected by hub 65*c*. An annularly disposed channel 80 is bolted to plate 65*b* by bolts 81, and an annular flange 82 is bolted to arm portion 37*a* by bolts 83. Flange portion 84 is slidably received in channel 80, and supports the weight of the plate 65 together with the several tool drives. With the rotation of platform 65 as indicated by arrow F, flange portion 84 slides in channel 80.

Four tool drives 20 (typical) similar to the drive heretofore mentioned, are radially disposed on platform plate 65*a* and face outwardly in different directions, so that at least one tool drive with tool is facing outwardly in the direction of a work area.

Each tool drive 20 comprises a hydraulic cylinder 71, held within frame 72, and pivotally mounted at pin 73 to base 74 which in turn is bolted to top plate 65*a* of platform 65. A rotatable shaft 75 is operably mounted to drive cylinder 71 so as to be rotated thereby and connector 40 is mounted to shaft 75 for rotation therewith. Hydraulic lines 76 provide interconnection between drive cylinder 71 and chamber 11 for actuation from within chamber 11. A hydraulic cylinder 77 and ram 78 are pivotally interconnected at 79 to arm 80*a* fixed to drive 20, for each such drive. Cylinder 77 is mounted to plate 65*a* by bolted flange 81*a*. With the retraction and extension of ram 78, drive 20 is pivoted in the directions of arrows G1 and G2, respectively. This permits a wide latitude of movement of the connected tool for performing work at a subsea station. Hydraulic lines 82 interconnect to chamber 16 for actuation from within chamber 11.

A hydraulic drive 90 is housed within arm portion 19 and a rotatable shaft 91 extends through orifice 92.

Flange 93 is mounted to the end of shaft 91 and is in turn bolted to platform 65 by means of bolts 94. Hydraulic lines 95 interconnect drive 90 to chamber 11 for remote actuation from within the chamber, so as to rotate platform 65.

A hydraulic cylinder 96 is mounted to the bottom frame section 18*a* of arm portion 18, and retractably extensible ram 97 is slidably housed in cylinder 96. The outward end 97*a* of ram 97 is pivotally mounted at 98 to flange 99 which is mounted to the bottom frame 19*a* or arm 19, by bolts 100.

Another tool drive 20 may be housed on platforms, and such tool drive may be fitted with a clamp 101 to hold box or rack 102 in a stationary manner. Rack 102 may be used to supply tools or posts for use in conjunction with work to to performed at the undersea station. Further the weight of the tool box assembly 102 may serve to counterbalance the weight of platform 65, so as to minimize the strain on shaft 30.

In the aforesaid manner of construction, arm portions 37*a* and 37*b* may be simultaneously retracted to clear guides 16*a*, 16*b*, and arm 36 then rotates in increments of 180°, so that alternatively platform 65 or platform 38 may be in facing opposition to a subsea station. More specifically the tools or parts associated with the respective platforms may be disposed adjacent the underwater work station. Further a tool drive assembly 20 of arm 19 may work in conjunction with a tool drive assembly 20 of arm assembly 65.

In performing work the reaction forces of the several tools performing work at a subsea station is taken up by the chamber being fixedly held to the guide wires so that there is little or no movement of the chamber with the tools engaging the subsea station.

It is also within the contemplation of this invention to provide tool members in addition to the socket wrench as depicted in the preferred embodiment. Other rotatable work tools are also within the contemplation of this invention. Further while rotatable tool drives are depicted, other tool drive means are also within the contemplation of this invention.

It is also to be understood that the plurality of hydraulic lines may be conveniently coupled to minimize the number of lines being interconnected to the submergible chamber. Still further the various types of drives may be remotely actuated as by electrical connections, radio command signals and the like.

As many possible embodiments may be made of the invention without departing from the scope thereof, it is to be understood that all matter herein set forth or shown in the accompanying drawings is to be interpreted as illustrative and not in a limiting sense.

What is claimed is:

1. A work arm system for a submergible chamber comprising, a submergible chamber, means mounted to and outwardly disposed from the chamber to hold said chamber at a submerged depth adjacent a work area, first and second work arms rotatably mounted to said chamber, said arms being in spaced relationship along the axis of the chamber, and where in said second extends outwardly from the chamber in two directions, and means at at least one end of each arm to mount a tool, so that the tool mount ends of at least two arms may be opposed to the work area.

2. The work arm system of claim 1, wherein said arms are retractably extensible.

3. The work arm system of claim 1, wherein said two tool mount arm has oppositely disposed retractable extensible portions.

4. The work arm system of claim 3, wherein at least one tool mount end of said two tool mount arm comprises a rotatable platform, a plurality of tool drive means being mounted on said platform, and means to rotate said platform so that each of the tool drives may in turn be disposed away from the chamber and opposed to the work area.

5. The work arm system of claim 4, said means to hold said chamber comprising means to hold the chamber to spaced vertically disposed guides, and means to rotate said two-ended arm 180°, so that with said two arm portions retracted, said arm is rotated 180° to provide for disposition of each end with said work area.

6. The work arm system of claim 1, further comprising a first work arm housing mounted to the bottom of said chamber and means to mount one arm to said housing, a second work arm housing mounted to said first work arm housing and means to mount said second arm to said second work arm housing.

7. The work arm system of claim 6, said second work arm housing being formed with a window portion through which said arm extends.

8. The work arm system of claim 7, wherein each of said arms is rotatable about the axis of said chamber.

9. The work arm system of claim 1, wherein one end of said second arm further comprises a work tool mounted thereon and the other end of said second arm comprises a plurality of tools mounted thereon.

10. The work arm system of claim 1, wherein at least one tool mount end comprises a rotatable platform, a plurality of tool drive means being mounted on said platform, and means to rotate said platform so that each of said tool drives may in turn be disposed away from said chamber and opposed to the work area.

11. The work arm system of claim 10, wherein one of said tool drives is pivotally mounted about an axis transverse to the axis of platform rotation, and means to pivot said tool drive.

12. The work arm system of claim 10, said means to rotate said platform being mounted on a work arm portion, said arm portion being retractably extensible with the other portion of the work arm .

13. The work arm system of claim 1, wherein the chamber is spherical and wherein the axis is a diameter of the chamber.

14. The work arm system of claim 13, further comprising means to attach a lift wire to chamber so that the lift wire is coaxial with the axis of the chamber about which the arms rotate.

* * * * *